United States Patent [19]

Caillet

[11] Patent Number: 5,005,629

[45] Date of Patent: Apr. 9, 1991

[54] COMPACT CURTAIN FOR THE CLOSURE OF PASSAGES

[76] Inventor: René Caillet, B.P. 19, F-78101, Saint Germain En Laye, France

[21] Appl. No.: 309,768

[22] PCT Filed: May 5, 1988

[86] PCT No.: PCT/FR88/00220

§ 371 Date: Mar. 6, 1989

§ 102(e) Date: Mar. 6, 1989

[87] PCT Pub. No.: WO88/08915

PCT Pub. Date: Nov. 17, 1988

[30] Foreign Application Priority Data

May 7, 1987 [FR] France ..... 87 6459

[51] Int. Cl.[5] ..... E06B 9/06

[52] U.S. Cl. ..... 160/84.1; 160/35

[58] Field of Search ..... 160/84.1, 236, 35, 33, 160/207; 292/218, DIG. 35

[56] References Cited

U.S. PATENT DOCUMENTS 2,274,216 2/1942 Sanders ..... 160/207

FOREIGN PATENT DOCUMENTS 2179268 11/1973 France .

553240 12/1956 Italy ..... 160/33

*Primary Examiner*—Blair M. Johnson

*Attorney, Agent, or Firm*—William A. Drucker

[57] ABSTRACT

A low bulk curtain is provided for the closure of passages, comprising a succession of high inertia elements each formed by a wide central web and a reinforcement flange, and hinged together by hinges. The curtain opens out under the effect of gravity for closing the passage and, in its raised position obtained by a chain and drum device, its interfitting elements only occupy a minimum space. Means are provided for ensuring sealing between the curtain elements as well as laterally and with the ceiling.

14 Claims, 5 Drawing Sheets

COMPACT CURTAIN FOR THE CLOSURE OF PASSAGES

BACKGROUND OF THE INVENTION

The invention applies to the closure of passages where there is in particular a space problem.

The installation of a closure curtain which is resistant, sealing and fire-proof is often impossible in some cases such as car ferries or parking places, where any projection over the whole width of the ceiling or along the side walls reduces the section for passage of the vehicles over the whole surface of use.

An object of the present invention is to overcome this drawback and for this it provides a closure curtain which, while having great strength with respect to the hydrostatic pressure and shocks and providing excellent sealing, in the open position only takes up a minimum amount of room.

SUMMARY OF THE INVENTION

According to the invention, the curtain comprises a succession of thin high inertia metal sheet elements each formed of a shaped section comprising a wide central web and at least at one end a reinforcement forming an angle with said web, the shaped sections having hinged connections and being designed to fit into each other, in the open position of the curtain, with a minimum space occupation and to be positioned in a housing in a wall of the premises and, in the closed position, to open out across the passage, said shaped sections being possibly equipped with sealing members automatically providing sealing therebetween in the opened out position of the curtain, and sealing means being possibly provided for sealing the curtain on the sides thereof, whereas actuating members provide for operation of the curtain so as to pass from its open position to its closed position and conversely.

The shaped sections forming the curtain of the invention may have an L profile, the reinforcement part being practically perpendicular to the web of the section, and a hinge is disposed in the angle of the section and is connected to the end of the central web of the preceding section. In other embodiments, each shaped section may have, at the ends of the central web, two reinforcements substantially perpendicular to this web directed either in the same direction (U shaped profile) or in opposite directions (Z shaped profile), a hinge connecting together the adjacent reinforcements of two successive elements.

For closure, the curtain moves from top to bottom, which makes an emergency operation possible under its own weight, and its elements have decreasing dimensions so that the lower elements, exposed to the hydrostatic pressure or to shocks (from vehicles for example) are more resistant.

The device advantageously uses two slanted side walls, with inclined supports which serve as bolts. Sealing is provided by the pressure of the curtain on the seals carried by the side walls, due to the slant of the seals with respect to the movement of the curtain. Such sealing may be completed by a device for applying the seal, by inflation or by movement of the support wall. Such movement of the wall may have a sufficient amplitude to bring to a vertical position so as to have the maximum passage section available.

BRIEF DESCRIPTION OF THE DRAWINGS

To better understand the curtain of the invention, several preferred embodiments thereof will be described hereafter by way of examples without any limitative character, with reference to the accompanying drawings in which:

FIG. 1 is a vertical sectional view of a first embodiment of a curtain according to the invention, formed of a sucession of L shaped sections whose opening and closure movements take place vertically.

DESCRIPTION OF THE PREFERRED EMBODIMENTS

Figure 14:
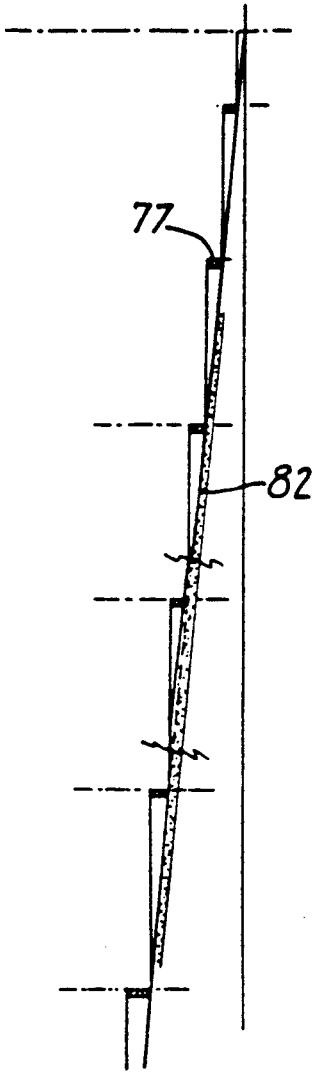
FIG. 14 is a vertical section through line XIV—XIV of FIG. 13.

The closure curtain shown in FIG. 1 is suspended from the ceiling 1 of the passage to be closed and it is designed so that, in the open position, it occupies a minimum space by being housed entirely between two beams 2 of the ceiling. This curtain is formed of a succession of shaped metal elements made from thin high inertia metal sheeting with an L section comprising a wide central web 3 and, at one end, a reinforcement formed by a flange 4 practically perpendicular to web 3. The successive elements are joined together by a hinge 5 disposed in the angle of the section and which cooperates with the end of the web 3 of the preceding section. The curtain is suspended from ceiling 1 by means of a fixed vertical panel 6 disposed between beams 2 and parallel thereto, and at the base of this fixed panel 6 is hinged, by means of a hinge 7, the upper edge of a pivoting flap 8 whose base is hinged to the hinge 5 equipping the first element of the curtain. It will be readily understood that, in the closed position, the successive elements open out under the action of their own weight until the last element 11 engages the floor 12 of the premises (position shown with a continuous line in FIG. 1). In the open position (shown by broken lines at the top of FIG. 1) the elements of the curtain fit together and occupy a minimum space. The elements of the curtain have decreasing dimensions, the lower elements, exposed to the hydrostatic pressure and shocks, having large dimensions therefore being more resistant.

Figure 2:
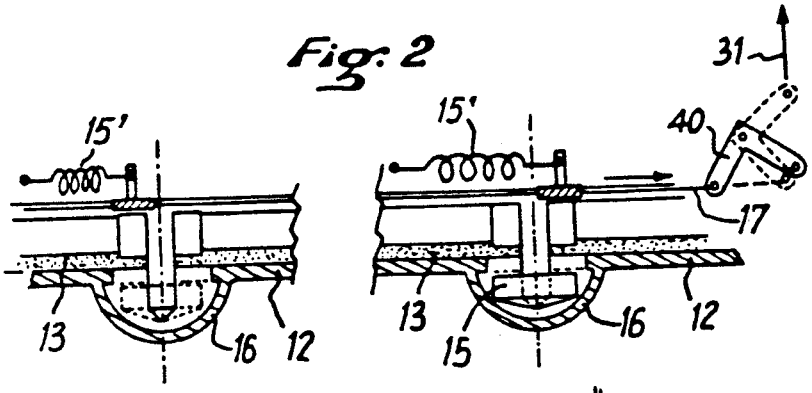
FIG. 2 is a vertical section on a larger scale through line II—II of FIG. 1, showing the system for locking the last element of the curtain to the ground.

As can be seen in FIGS. 1 and 2, the last element 11 of the curtain is sealed with the floor 12 by a compression seal 13 fixed by means of a flat bar 14 to the base of the external face of flange 4 of this last element. Seal 13 is clamped over the whole width of element 11 by a system similar to the known system for taking hold of container corners, comprising rotary bolts 15 carried by element 11 and engaging in pots 16 embedded here and there in floor 12. Each bolt 15 is equipped with a spring 15' holding it in the locked position, when they are joined together by a rod 17, itself connected to a control member (not shown) which, when actuated, brings the bolts 15 simultaneously into their unlocked position. For understanding the operation, in FIG. 2, the left-hand bolt has been shown in the locked position and the right-hand bolt in the open position.

It will be readily understood that clamping of the lower element of the curtain against the floor and locking of this element in this position could be provided by other appropriate means, e.g. pivoting hooks.

Figure 3:
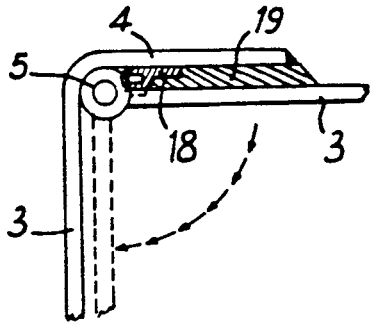
FIG. 3 is a detail view showing the sealing between two successive elements of the curtain of FIG. 1.

Sealing between two successive elements of the curtain is obtained, as shown in FIG. 3, by means of a compression seal 8 fixed by means of a flat bar 19 to the internal face of flange 4 of each element, at the level of hinge 5. In the opened out position of the element, which position is shown with a continuous line in FIG. 3, seal 18 is compressed by the central web 3 of the preceding element of the curtain, thus providing sealing over the whole width of the connection between the two elements. In the top part, the connection between the first element 9 of the curtain and flap 8 comprises the same type of seal.

In the closed position, vertical sealing at the sides of the curtain (see FIG. 1) is obtained by means of an inflatable seal 20 disposed, on each side, in a housing 21 in the vertical wall 22 and adapting itself to all the contours of the sections forming the curtain. Without departing from the scope of the invention, instead of an inflatable seal, a compressible seal could be used which, at rest, would project in the path of the edges of the curtain.

Figure 4:
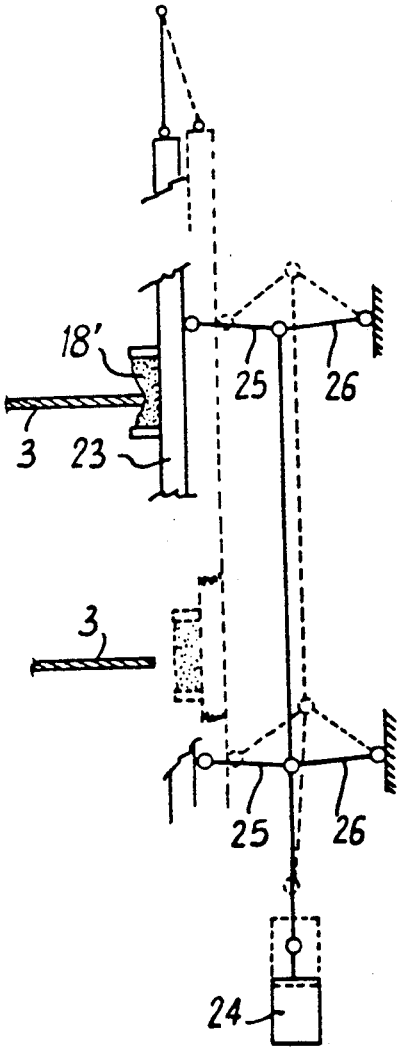
FIG. 4 shows, in a variant, a side wall device with transverse movement providing lateral sealing of the curtain.

In a variant, to avoid wear of this compressible seal, in FIG. 4 a vertical wall element 23 has been provided carrying the seal 18'. Wall element 23 may move, by means of one or two hinges, so as to come to the position shown with broken lines where seal 18' is disengaged. This slight movement is provided by a jack 24 acting on a set of links 25, 26 providing self-locking (closed position).

The curtain is raised, at each lateral end of the curtain, by two chains 31, 32, the first of which is connected to the low part of the last element 11 of the curtain, in the closed position thereof and the second of which is connected to the top part of said last element. Chains 31, 32 are pulled by drums, respectively 33, 34, which are housed in the space defined between the beams 2 and which are rotated by a power driven reducer 35. At the beginning of the raising operation, drum 33 brings the last element 11 into its horizontal position, shown with broken lines at A in FIG. 1. On drum 34 chain 32 has a length and an attachment point such that it only begins to act when the last element 11 is horizontal. The action of the two drums then causes the last element to be raised to the horizontal position, then the elements to be fitted successively in each other in the horizontal position until the open position is obtained, shown at the upper part of this Figure. The elements of the curtain, during the raising or lowering operations, are guided by slides 36, 37 carried by the side walls 22 and with which rollers, respectively 38, 39, cooperate carried at both ends by the last element 11 of the curtain. Such guiding limits the space occupied due to swinging of the curtain during operation. It will be noted that chain 31 connected to the last element 11 of the curtain may, at the beginning of the tractive force which is applied thereto by winch 33, cause unlocking of the pivoting bolts 15 by being connected, through a pivoting link 40, to rod 17 (see FIG. 2).

During lowering of the curtain, the curtain elements are positioned by flanges 4 being buttressed against the webs 3 of each element. However, so that such buttressing does not abnormally fatigue the hinges 5, steadying chains 41 are used connecting together brackets 42 carried by the superimposed flanges of two curtain elements (see FIG. 1).

Figure 5:
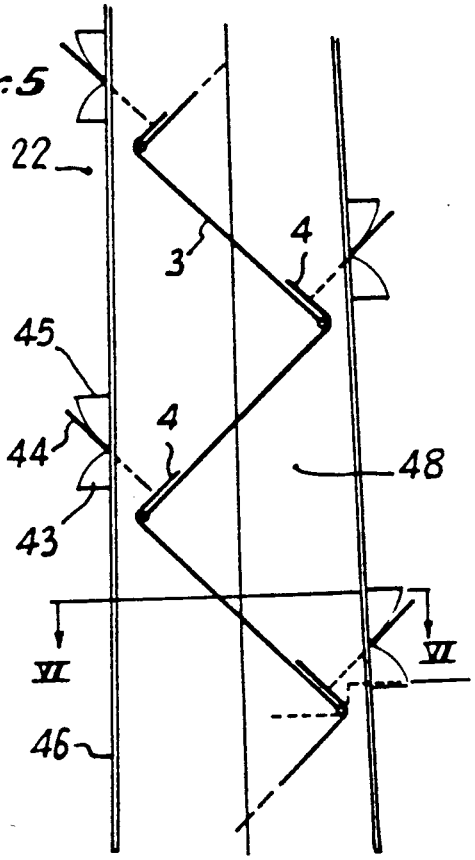
FIG. 5 is another variant showing a system for automatically positioning the elements of the curtain during its downward movement.
Figure 6:
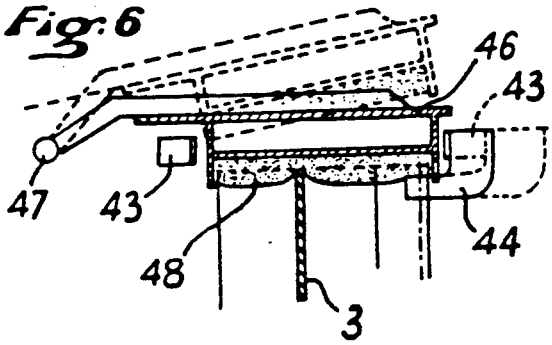
FIG. 6 is a horizontal section through line VI—VI of FIG. 5.

In FIGS. 5 and 6 a variant of the device has been shown providing, during lowering, correct positioning of the curtain elements as well as relieving the forces on the hinges 5 of the elements. For this, on the fixed side wall 22, supports 43 are installed on which brackets 44 carried by the flanges 4 of the curtain elements come to bear during the closure operation. With each support 43 there is associated a projecting element 45, also carried by wall 22, which acts on bracket 44 so as to impart thereto a rotational movement and force it to be applied exactly on support 43. In FIGS. 5 and 6 the pivoting side wall 46 has been shown, hinged at 47 and which carries a compression seal 48 (shown with a continuous line in the sealing position in FIG. 6) whose width corresponds to the lateral dimension of the curtain.

Figure 7:
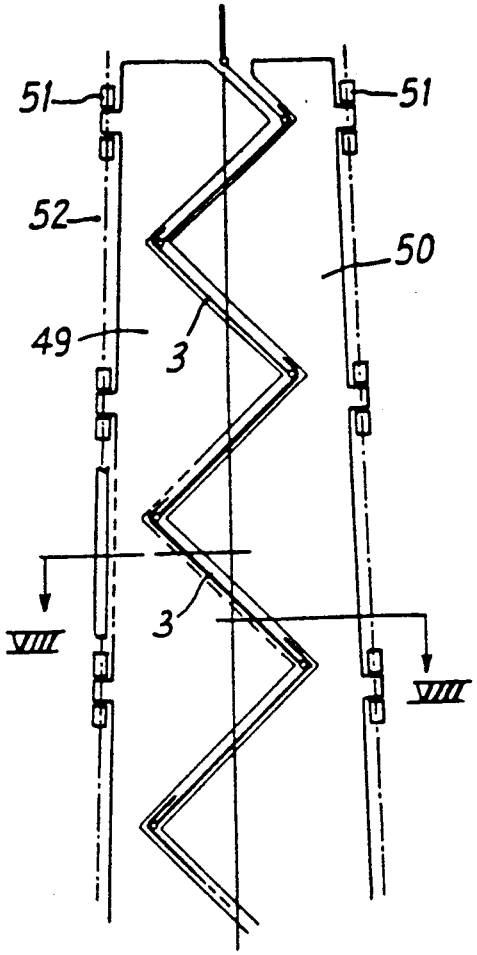
FIG. 7 is another variant showing the device absorbing the horizontal forces applied perpendicularly to the curtain.
Figure 8:
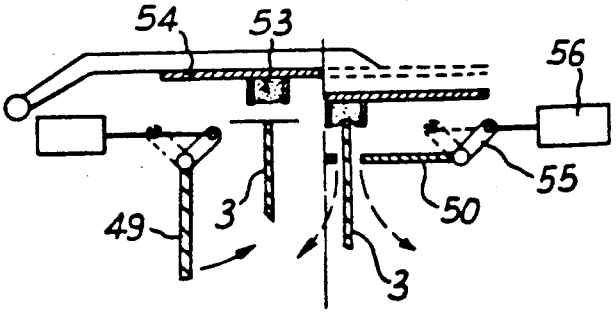
FIG. 8 is a horizontal section through line VIII—VIII of FIG. 7.

If horizontal forces perpendicular to the curtain are very high, they may be absorbed, as shown in a variant in FIGS. 7 and 8, by two complementary saw-tooth panels 49, 50 hinged by hinges 51 to the vertical side wall 52. Panels 49, 50 are disposed on each side of the curtain, in its closed position, so as to serve as supports for the hinged portions thereof. The hinged panels 49, 50 open during operation, coming into the position of panel 49 shown in the left-hand part of FIG. 8, and these panels are closed again (position shown in FIG. 7 and in the left-hand part of FIG. 8) when the curtain is opened or closed, which operation is provided by a link 55 and jack 56 device. In FIG. 8 the pivoting side wall element 54 has been shown carrying the seal 53, the latter being of a width corresponding to that of the panel element. Seal 53 is shown in the sealing position in the right-hand part of the Figure and in the released position in the left-hand part of the Figure, the operation being provided by a single hinge device of the type described in FIG. 4.

Figure 9:
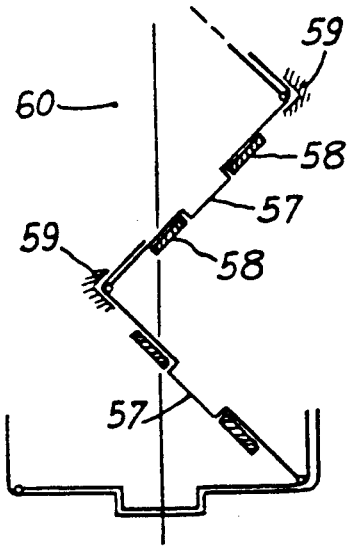
FIG. 9 is another variant of a system for absorbing the forces applied to the curtain formed of L shaped sections.

As a variant, as shown in FIG. 9, the horizontal forces perpendicular to the curtain are absorbed by placing at the lateral ends of the curtain elements recessed portions 57 which have increasing dimensions so as not to hinder the fitting together of the elements of the curtain during opening. The recessed portions 57 correspond to stops 58 or to housing 59 carried by the fixed side wall 60. In this Figure, the curtain is shown during raising and, for the clarity of the drawings, the chain and winch system providing such raising has not been shown.

Figure 11:
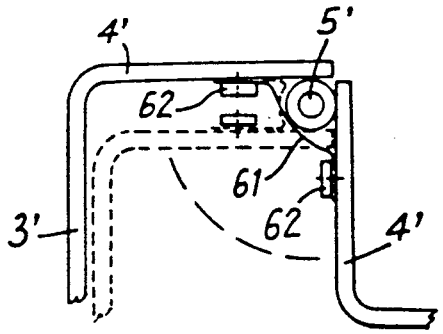
FIG. 11 is a detail view showing the sealing between two successive elements of the curtain of FIG. 10, in the opened out position of this curtain.
Figure 10:
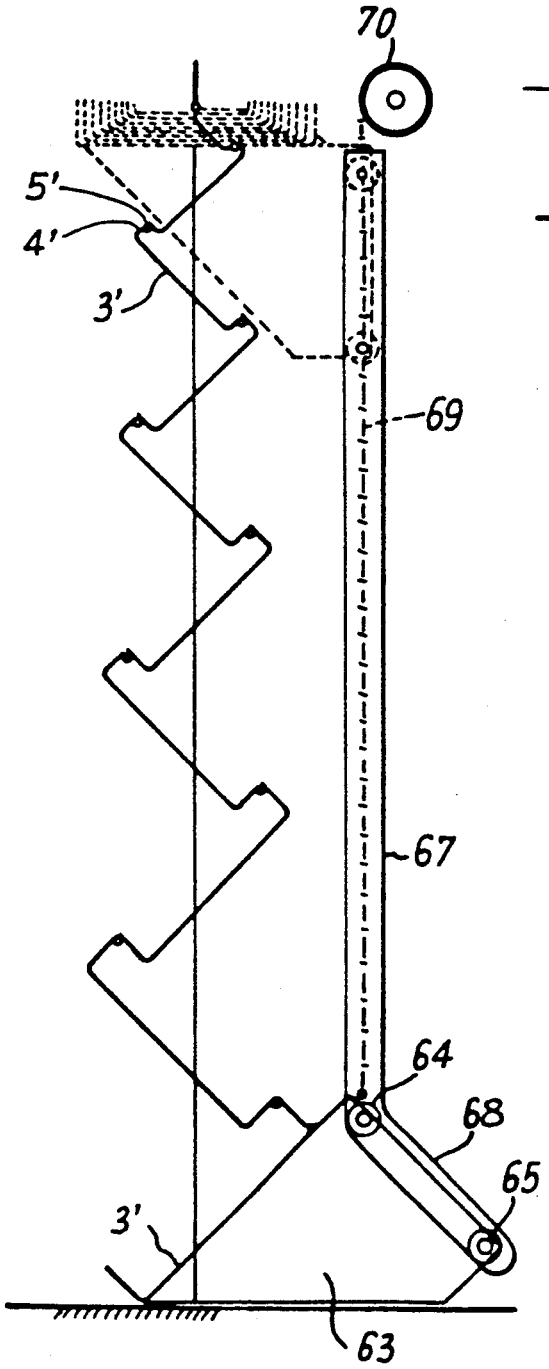
FIG. 10 is a vertical sectional view of a second embodiment of the curtain of the invention, formed of a succession of U shaped sections.

Referring to FIG. 10, a second embodiment has been shown of a curtain of the invention formed of a succession of U sections comprising a central web 3' ending at each end in a flange 4' forming a reinforcement oriented at 90°. Flange 4' of a curtain element and that of the next element are joined together by a hinge 5' allowing them to open out in the closed position (position shown with a continuous line in FIG. 10). The central web 3' and the flanges 4' of the elements of the curtain have an increasing length from the first to the last element, so that, in the open position, the elements fit together while occupying a minimum space (position shown with broken lines in this Figure). As shown in the detail view of FIG. 11, sealing between two successive elements of the curtain is obtained by a flexible strip 61 fixed, by flat bars 62, to the opposite faces of the adjacent flanges 4' of two successive curtain elements, on each side of the hinge 5' joining these two elements together. In FIG. 11, the two curtain elements have been shown with broken lines in their fitted together position.

In FIG. 10, for the sake of clearness of the drawings, the systems for sealing the last element to the floor have not been shown, but they may be identical to those described in connection with the embodiment of FIG. 1. The last element of the curtain has at each end, via a gusset 63, two rollers 64, 65 spaced apart from each other, cantilevered outwardly and aligned in a direction perpendicular to the central web 3' of the latter element. In the closed position of the curtain shown in FIG. 10, the upper roller 64 is engaged in the rectilinear portion of a vertical guide rail 67 whereas the lower roller 65 cooperates with the lower bent end 68 of rail 67. A cable 69 connects the last element of the curtain to a winch 70. During raising of the curtain, the beginning of movement of roller 64 in the vertical rail 67 under the effect of the tractive force from cable 69, causes the last element to pivot in a clockwise direction until the lower roller 65 is engaged in its turn in the rectilinear part of the rail, which corresponds to a horizontal position of the central web 3' of the last element. Further raising then causes the last element to rise into the horizontal position and successive folding up of the following elements thereinside, until the completely open position shown with broken lines has been obtained.

Figure 12:
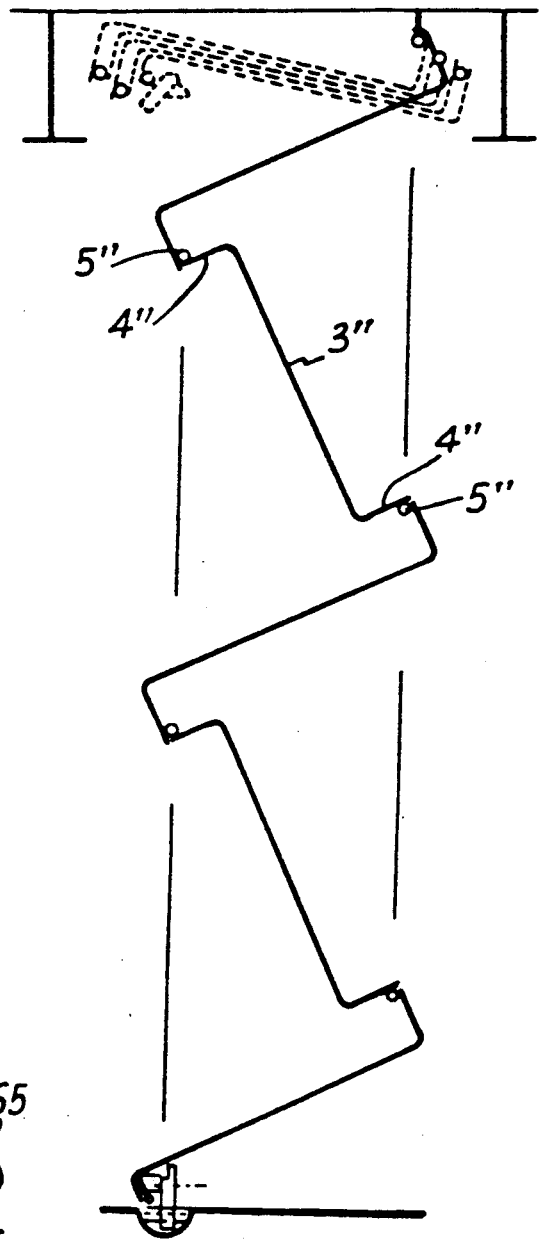
FIG. 12 is a vertical sectional view of a third embodiment of the curtain of the invention, formed of a succession of Z shaped sections.
Figure 10:
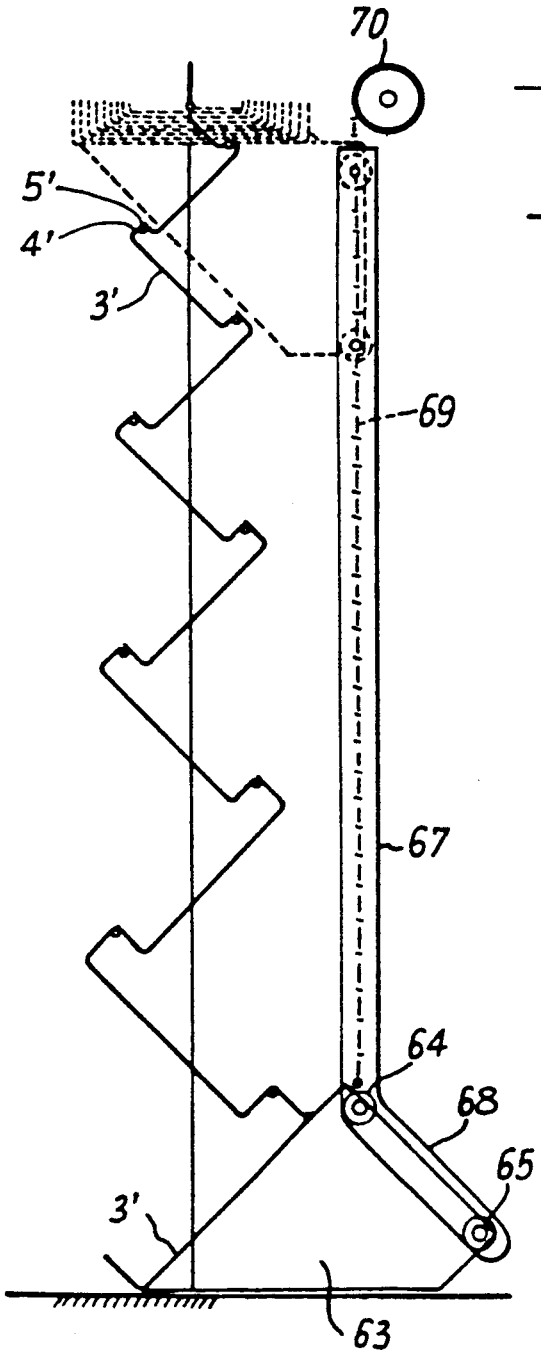
Figure 12:
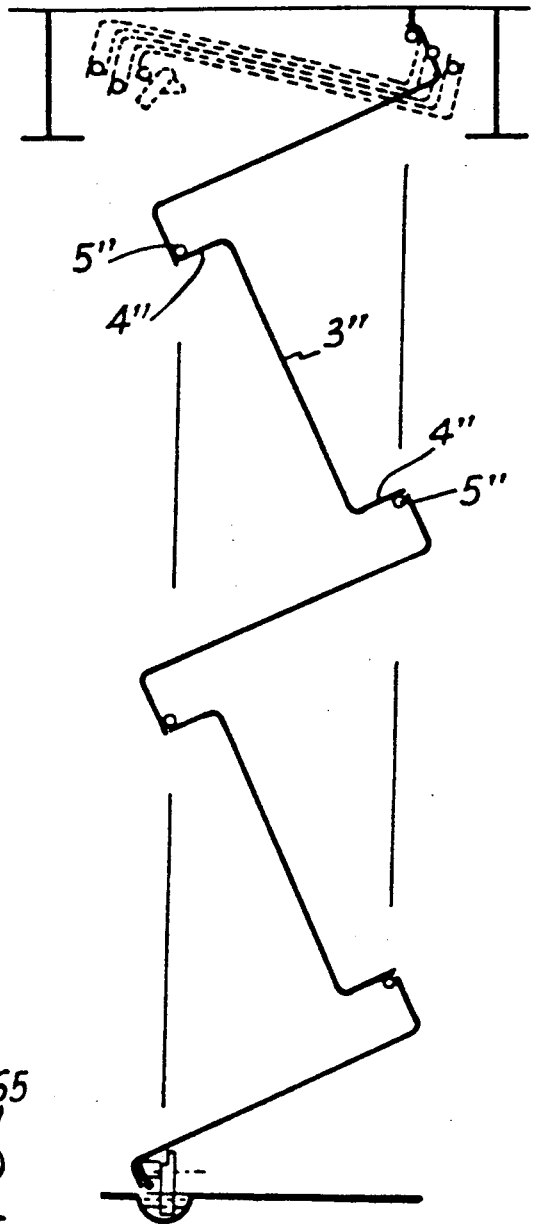

In FIG. 12 another embodiment of the curtain of the invention has been shown, in which each element is formed by a Z section whose central web 3'' is extended at both ends by two reinforcement flanges 4'' which are practically perpendicular thereto and oriented in opposite directions. Flange 4'' of one element is connected to the adjacent flange 4'' of the next element by a hinge 5''. In this Figure, the raised position of the curtain has been shown with broken lines, in which the fitted elements have a slant for minimum space occupation. For simplifying the Figure, the sealing means have not been shown but they could be those shown in FIG. 3 or in FIG. 11.

Figure 13:
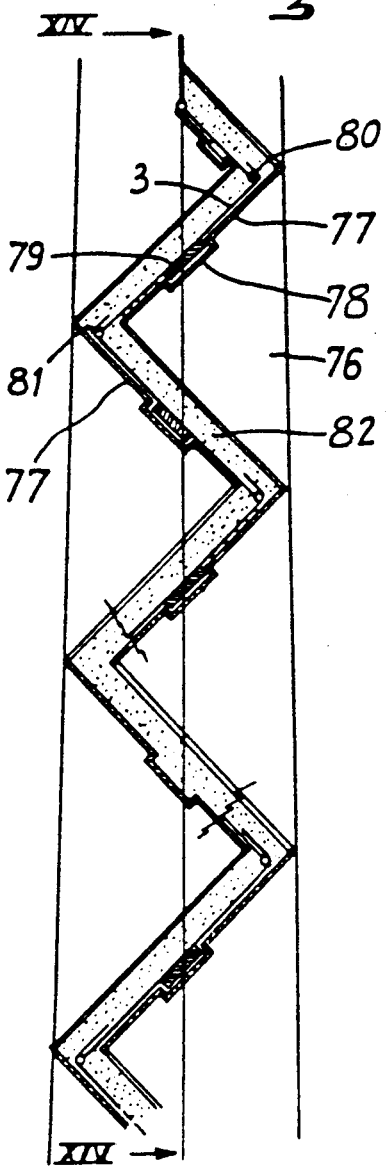
FIG. 13 is a vertical sectional view, with parts cut away, of a curtain opened out between two oblique lateral uprights.
Figure 15:
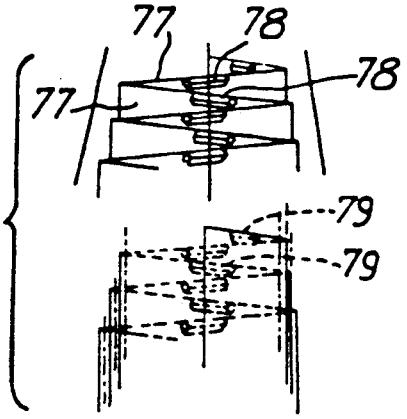
FIG. 15 is a top view of FIGS. 13 and 14.

In FIGS. 13 to 15 the case has been shown in which the curtain has a trapezoidal shape for providing closure between two lateral fixed oblique uprights for reducing the wear of the compression seals during closure of the curtain. For absorbing the forces and for the vertical positioning of the curtain, each lateral oblique upright 76 is then provided with supports 77 disposed like slanting steps and each comprising a housing 78 receiving a projection 79 carried by the external face of the central web 3 of the curtain element intended to come to bear thereon. During lowering of the curtain, the first element connected to the ceiling will necessarily come to its correct position, the connection 80 hinged to the second element coming to bear on the second step 77 and projection 79 engaging in the housing 78 of the first step. By rotating about the hinged connection 80 thus immobilized, the connecting part 81 between the second and the third elements also comes necessarily into its correct position and is immobilized on the third step 77 by projection 79 coming into its housing 78 in the second step, and so on until the curtain is completely lowered.

The resilient seal 82 carried by the oblique upright, for a better representation of which curtain elements partially cut away have been shown in FIGS. 13 and 14, follows the shape of the shaped sections forming the curtain elements and studs 79.

It will be understood that, for a better understanding of FIG. 15, the curtain and the upright with oblique support elements have been shown apart from each other but that, in actual fact, these elements are superimposed.

It will be readily understood that the above description has been given solely by way of example, without any limiting character and that constructional additions and modifications could be made thereto without departing from the scope of the invention defined in the following claims.

What is claimed is:

1. A curtain of small bulk for closing a passage, which comprises a succession of substantially planar elements comprising at one end a first element suspended to an upper part of the passage and at the other end a last element adapted in a closed position of the curtain to engage a lower part of the passage, said curtain moving for closure in a vertical plane from the upper part to the lower part of the passage, the elements are configured so that, while in an open position of the curtain, the elements fit into each other while being horizontally disposed, said elements each being formed by a shaped metal sheet section of high inertia and reduced size and each comprising:

(a) a wide central web and at least at one end a reinforcement forming an angle with said web, and (b) hinge means connecting together one end of said element to a preceding element and the other end of said element to a following element, said elements having increasing dimensions from said first element to said last element, so that the most exposed lower elements can withstand hydrostatic pressure and shocks.

2. The curtain as claimed in claim 1, wherein sealing between the shaped sections, when the curtain is in the closed position, is provided by a seal fixed to the reinforcement of the section in the vicinity of the hinge and intended to be compressed by the portion of the adjacent section connected to said hinge, said seal being fixed to said reinforcement by a metal seal holder which increases the inertia of the curtain.

3. Curtain as claimed in claim 1, wherein further sealing means are provided on the last element of the curtain to ensure sealing between said last element and a bearing surface of this last element in the closed position of the curtain, said further sealing means comprising a seal disposed on an external face of said last element, rotary bolts being carried by said last element and being adapted to engage in housings formed in said bearing surface to obtain compression of the seal, said rotary bolts being spring loaded toward a locking position and being connected by a rod fast with an actuating member, a control of said actuating member providing simultaneous unlocking of the rotary bolts.

4. The curtain as claimed in claim 1, wherein other sealing means are provided to insure sealing at the sides of the elements of the curtain in the closed position thereof.

5. The curtain as claimed in claim 1, further comprising actuation members formed, at each lateral end, by two chains attached at two points to the last element of the curtain and each winding on a drum, means being possibly provided for temporarily delaying the winding up of one of the chains with respect to the other.

6. The curtain as claimed in claim 1, wherein the last curtain element has two rollers aligned in a direction practically perpendicular to the central web of this element, which cooperate with a vertical guide rail whose lower end is bent, one of the rollers being situated in said bent part of the rail in the closed position of the curtain whereas, during raising of the curtain under the action of a cable, the last element of the curtain pivots to a horizontal position before causing all the other elements of the curtain to be raised.

7. The curtain as claimed in claim 1, wherein the elements of the curtain comprise bearing members intended to engage support members presented by the side walls of the premises.

8. The curtain as claimed in claim 7, wherein said support members are formed by two saw tooth walls, hinged to said side wall and movable between a released position and a position in which they are engaged under the end of the elements of the curtain in the closed position of the latter.

9. The curtain as claimed in claim 7, having a trapezoidal shape for cooperating with oblique lateral uprights, wherein said oblique upright has support portions in the form of slanted steps, said support portions having housings in which, in the closed position, studs at the ends of the curtain elements are engaged.

10. The curtain as claimed in claim 1, wherein each shaped metal sheet section is an L-shaped section.

11. The curtain as claimed in claim 1, wherein each shaped metal sheet section is a U-shaped section.

12. The curtain as claimed in claim 1, wherein each shaped metal sheet section is a Z-shaped section.

13. The curtain as claimed in claim 1, wherein other sealing means are provided to insure sealing at the sides of the elements of the curtain in the closed position thereof, said other sealing means comprising a seal fixed to a support and adapted to engage said elements by an inclined movement of the support.

14. The curtain as claimed in claim 5, comprising means for temporarily delaying the winding up of one of the chains with respect to the other.

* * * * *